US008162457B2

(12) United States Patent
Nakamura et al.

(10) Patent No.: US 8,162,457 B2
(45) Date of Patent: Apr. 24, 2012

(54) INK SUPPLY DEVICE

(75) Inventors: Hirotake Nakamura, Nagoya (JP); Shingo Hattori, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 514 days.

(21) Appl. No.: 12/323,747

(22) Filed: Nov. 26, 2008

(65) Prior Publication Data

US 2009/0141097 A1 Jun. 4, 2009

(30) Foreign Application Priority Data

Nov. 29, 2007 (JP) ..... 2007-308607

(51) Int. Cl.
*B41J 2/175* (2006.01)

(52) U.S. Cl. ..... 347/86; 347/85

(58) Field of Classification Search ..... 347/85–87
See application file for complete search history.

(56) References Cited

U.S. PATENT DOCUMENTS

| | | | | |
|---|---|---|---|---|
| 5,166,707 | A | 11/1992 | Watanabe et al. | |
| 5,471,230 | A | 11/1995 | Saito et al. | |
| 5,481,283 | A | 1/1996 | Watanabe et al. | |
| 5,481,290 | A | 1/1996 | Watanabe et al. | |
| 6,322,205 | B1 * | 11/2001 | Childers et al. | 347/85 |
| 6,719,415 | B1 * | 4/2004 | Hattori et al. | 347/86 |
| 7,004,564 | B2 | 2/2006 | Steinmetz et al. | |
| 7,090,343 | B2 | 8/2006 | Steinmetz et al. | |
| 7,252,374 | B2 * | 8/2007 | Usui et al. | 347/84 |
| 2002/0149646 | A1 * | 10/2002 | Pawlowski et al. | 347/50 |
| 2005/0140749 | A1 * | 6/2005 | Usui et al. | 347/84 |
| 2007/0013753 | A1 | 1/2007 | Steinmetz et al. | |

FOREIGN PATENT DOCUMENTS

| | | |
|---|---|---|
| JP | 3-234653 | 10/1991 |
| JP | 6024474 | 2/1994 |
| JP | 2007-500619 | 1/2007 |

* cited by examiner

*Primary Examiner* — Ellen Kim
(74) *Attorney, Agent, or Firm* — Frommer Lawrence & Haug LLP

(57) ABSTRACT

An ink supply device includes a cartridge mounting portion for an ink cartridge. The ink cartridge includes: an ink chamber including a hole; and a cover configured to cover the hole. The cartridge mounting portion includes a cylinder extending in a horizontal direction and is configured to mount thereon the ink cartridge while opening the cover by the cylinder. The cylinder includes a tip surface including: a first contact surface provided in at least an entire first region of the tip surface and configured to contact the cover, the first region being located above an upper end of an inner surface of the cylinder and; a second contact surface provided in a second region of the tip surface other than the first region and configured to contact the cover, and a passage provided in the second region of the tip surface to extend in a radial direction of the cylinder to allow an inner space of the cylinder to communicate with an outside.

12 Claims, 10 Drawing Sheets

INK SUPPLY DEVICE

CROSS-REFERENCE TO RELATED APPLICATION

This application claims priority from Japanese Patent Application No. 2007-308607, filed on Nov. 29, 2007, the entire subject matter of which is incorporated herein by reference.

TECHNICAL FIELD

Aspects of the present invention relate to an ink supply device including an ink cartridge which is inserted into a cartridge mounting portion, and in which a cover for a hole through which an ink chamber communicates with the outside is opened by a cylinder.

BACKGROUND

An image recording apparatus which uses ink to record images on a sheet (recording medium) has been known as a related art. Such image recording apparatus includes an ink jet recording head, and selectively discharges ink droplets onto a recording sheet from nozzles of the recording head. The ink droplets are dropped on the recording sheet, and a desired image is recorded on the recording sheet. The image recording apparatus is provided with an ink container which stores ink to be supplied to the recording head. The ink container is generally a cartridge type, and can be inserted into or removed from a cartridge mounting portion provided in the image recording apparatus. This type of ink container is referred to as ink cartridge. When there is no ink in the ink cartridge, the ink cartridge is removed from the cartridge mounting portion of the image recording apparatus, and a new ink cartridge having ink stored therein is inserted into the cartridge mounting portion. The ink cartridge inserted into or removed from the cartridge mounting portion includes a hole which allows the inner space of the ink cartridge to communicate with the outside and a cover which seals the hole, and the cover is opened by, for example, an ink needle. In a configuration in which the cover sealing the hole is opened or closed by, for example, a valve, when the ink cartridge is removed from the cartridge mounting portion, the hole is closed, and ink is stored in the ink cartridge without leakage. On the other hand, when the ink cartridge is inserted into the cartridge mounting portion, the hole is opened, and ink can flow from the ink cartridge to the outside.

JP-A-3-234653 describes an ink supply system of a facsimile device in which a cartridge joint 79 is provided on a base 73 and a metal ball 99 is pressed against a joint opening 95a of an ink cartridge 86 by a spring 98. When the ink cartridge 86 is removed from the base 73, the joint opening 95a is sealed by the metal ball 99. When the ink cartridge 86 is inserted into the base 73, the cartridge joint 79 presses the metal ball 99 against the urging force of the spring 98, and the joint opening 95a is opened.

JP-A-2007-500619 describes a liquid interface having a ball seal structure. The liquid interface seals the contents of an ink cartridge. When a hollow needle is inserted to the liquid interface, the liquid interface drains the contents of the ink cartridge through the hollow needle.

As described above, the cartridge mounting portion to which the ink cartridge is inserted is provided with a cylinder which is inserted into the hole of the ink cartridge, such as a cartridge joint or a hollow needle. The leading end of the cylinder presses, for example, a ball of the ball seal structure which opens or closes the hole of the ink cartridge, thereby opening the hole. For example, as shown in FIG. 20 of JP-A-2007-500619, contact surfaces which contact the ball and cutouts through which ink flows are provided at specific intervals in the tip surface of the hollow needle in the circumferential direction of the hollow needle.

The ball seal structure is provided with, for example, members, such as a spring which urges the ball and a guide which guides the movement of the ball. The members of the ball seal structure are exposed to an air layer of the ink cartridge due to the packed state or the vibration of the ink cartridge while being transported, and air bubbles may be attached to such members. With the ink cartridge being inserted into the cartridge mounting portion, the members of the ball seal structure are kept being soaked in ink. However, the air bubbles attached to the members of the ball seal structure do not float in the ink, but are maintained in the attached state. In this case, when the air bubbles are drained from the ink cartridge together with ink, ink flow defects or ink discharge defects may occur in an ink passage or a recording head of an ink-jet printer.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a mechanism capable of preventing air bubbles in an ink cartridge from flowing from the ink cartridge together with ink and a mechanism capable of smoothly opening a cover that closes up a hole of an ink cartridge.

According to an exemplary embodiment of the present invention, there is provided an ink supply device including: a cartridge mounting portion for an ink cartridge. The ink cartridge includes: an ink chamber for storing ink, the ink chamber including a hole through which an inner space of the ink chamber is capable of communicating with an outside; and a cover which is configured to cover the hole. The cartridge mounting portion includes a cylinder extending in a direction intersecting with a gravity direction and is configured to removably mount thereon the ink cartridge while opening the cover by the cylinder. The cylinder comprises a tip surface including: a first contact surface provided in at least an entire first region of the tip surface and configured to contact the cover, the first region being located above an upper end of an inner surface of the cylinder in the gravity direction and; a second contact surface provided in a second region of the tip surface other than the first region and configured to contact the cover, and a passage provided in the second region of the tip surface to extend in a radial direction of the cylinder to allow an inner space of the cylinder to communicate with an outside.

BRIEF DESCRIPTION OF THE DRAWINGS

The above and other aspects of the present invention will become more apparent and more readily appreciated from the following description of exemplary embodiments of the present invention taken in conjunction with the attached drawings, in which:

FIG. 2A shows a slider disposed at an extended position, and FIG. 2B is the slider disposed at a contracted position;

FIG. 3A shows the slider disposed at the extended position, and FIG. 3B is the slider disposed at the contracted position;

DETAILED DESCRIPTION

Hereinafter, illustrative non-limiting exemplary embodiments of the present invention will be described with reference to the accompanying drawings. It will be understood by those skilled in the art that various changes in form and details may be made therein without departing from the spirit and scope of the invention as defined by the appended claims.

[Description of the Drawings]

Figure 1:
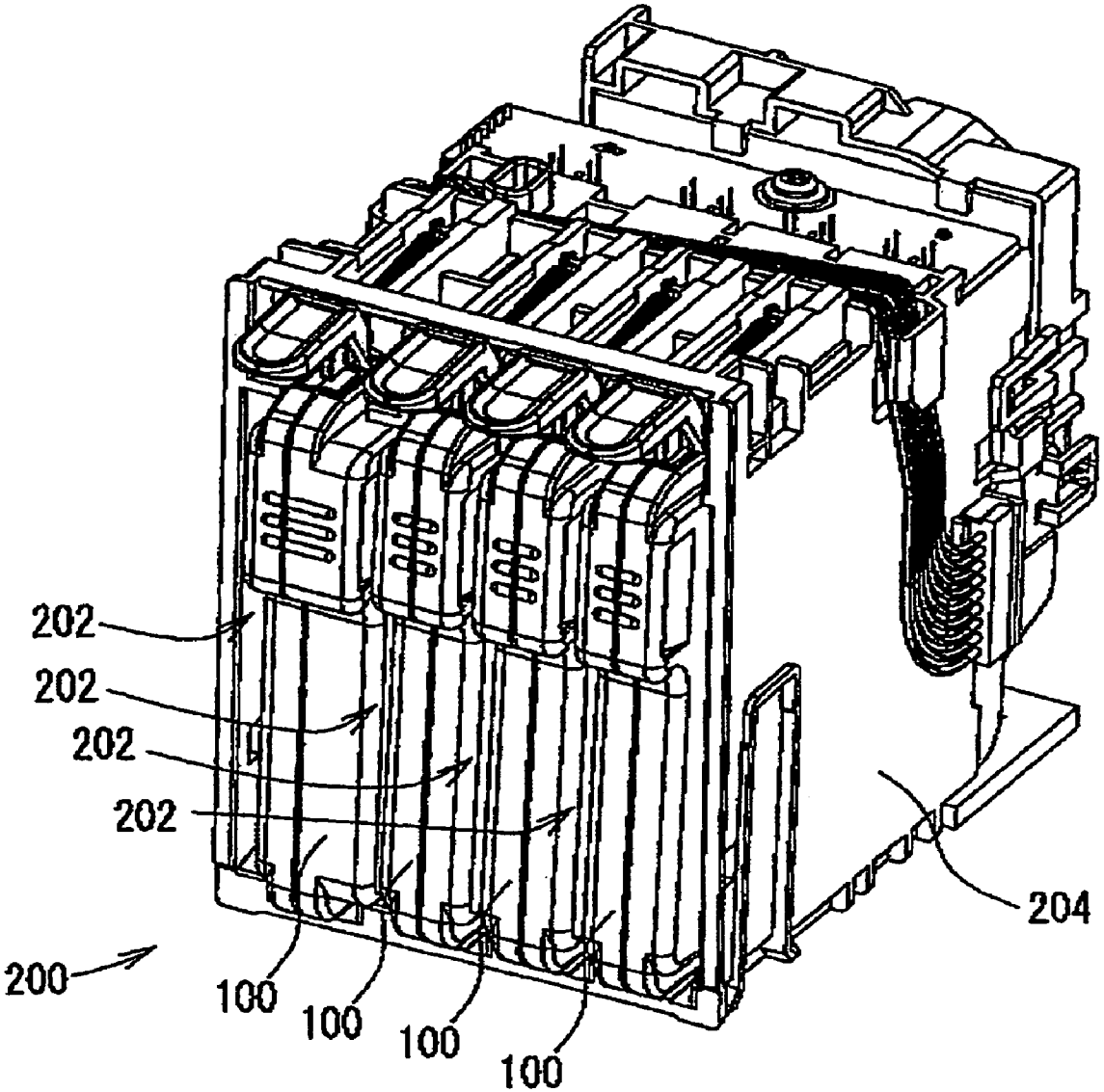
FIG. 1 is a perspective view illustrating the external configuration of an ink supply device according to an exemplary embodiment.
Figure 2B:
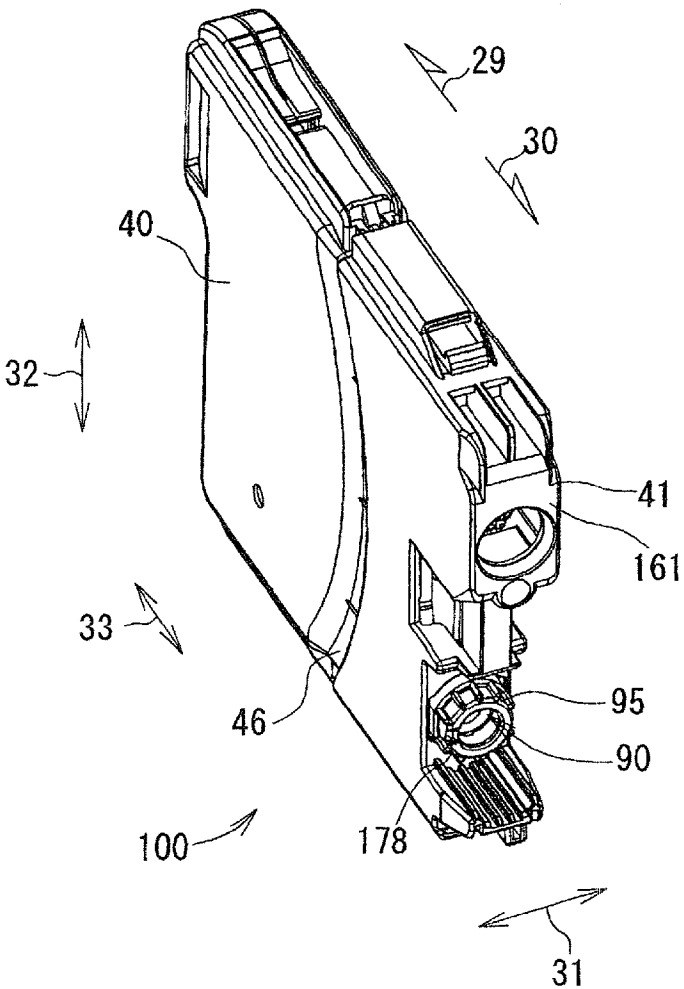
FIGS. 2A and 2B are perspective views illustrating the external configuration of an ink cartridge according to an exemplary embodiment.
Figure 2A:
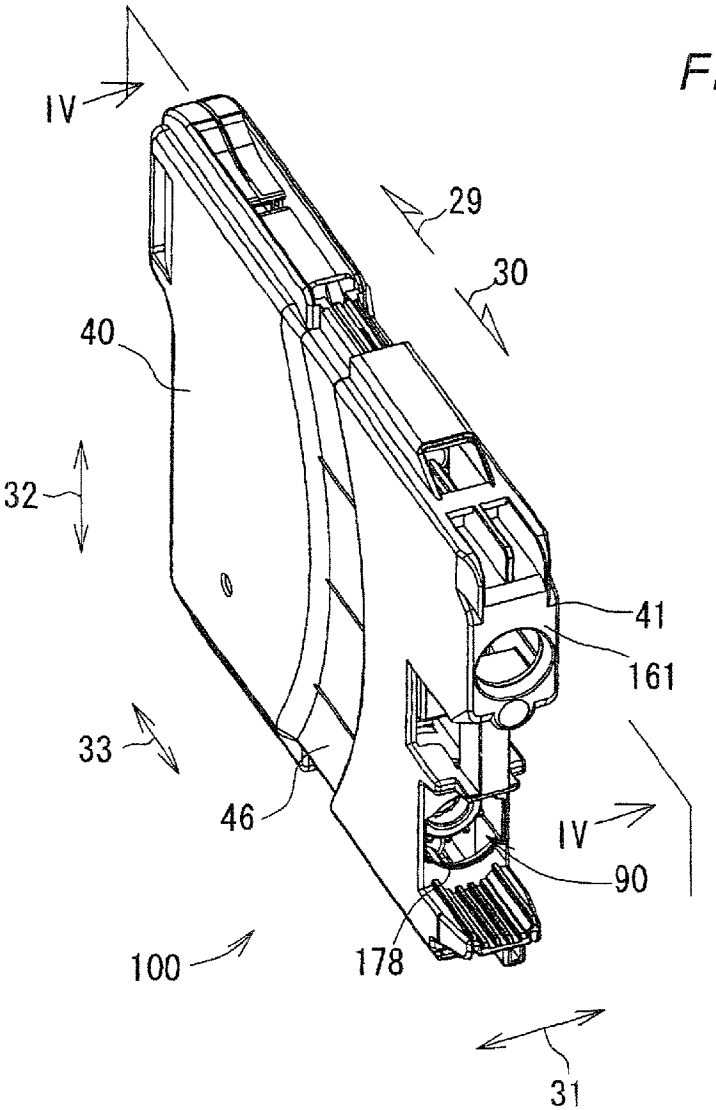
Figure 3A:
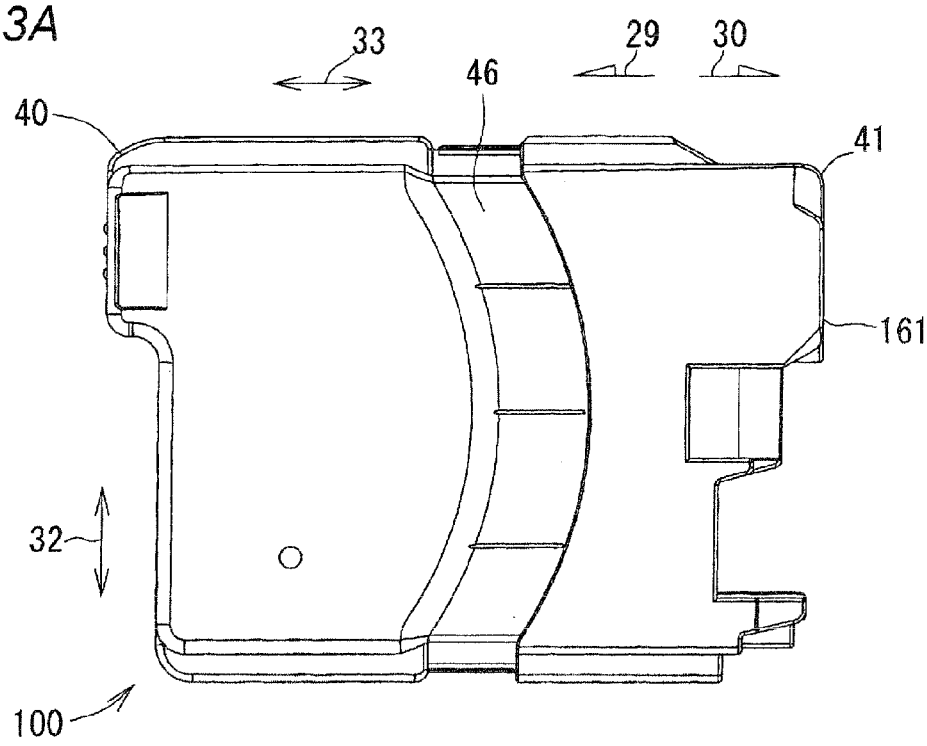
FIGS. 3A and 3B are side views illustrating the ink cartridge.
Figure 3B:
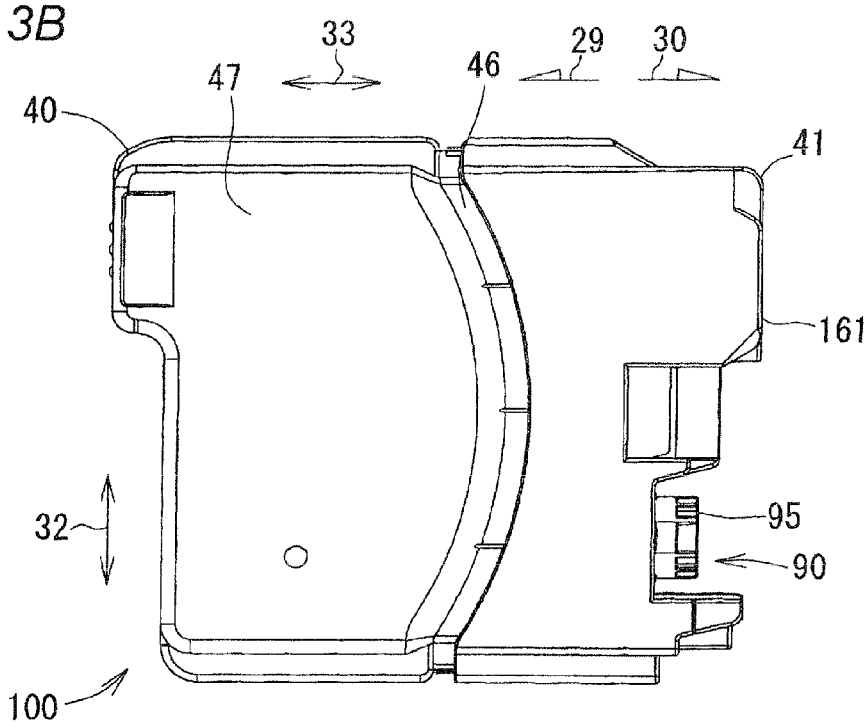
Figure 4:
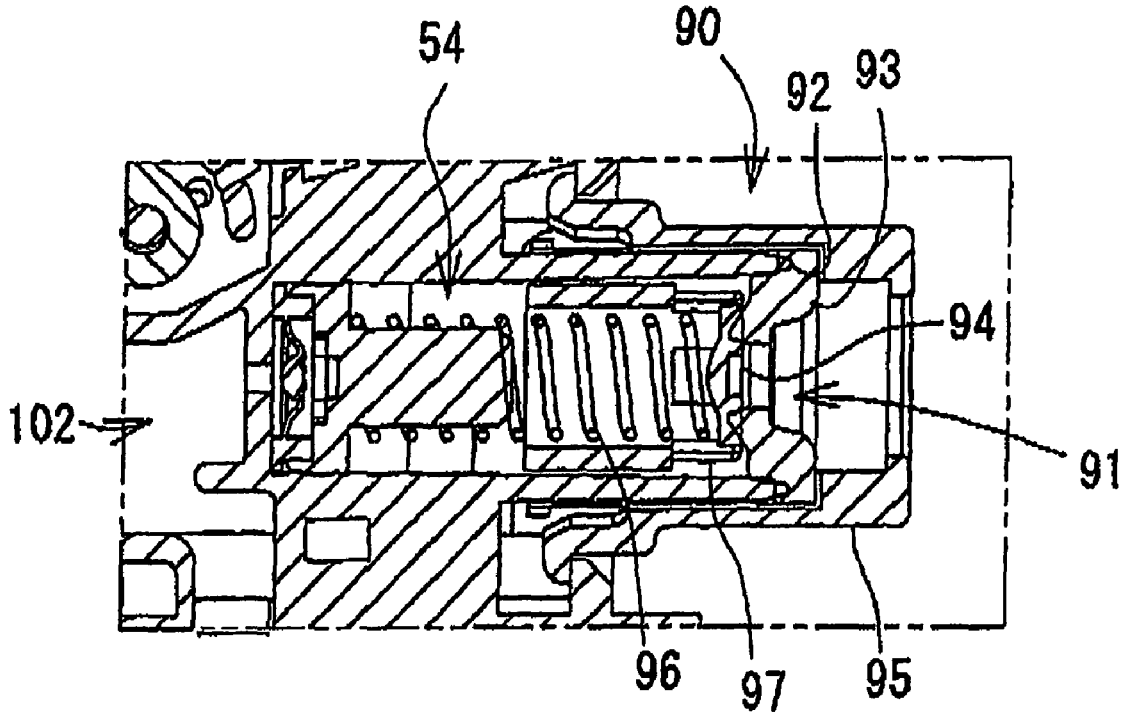
FIG. 4 is an enlarged cross-sectional view illustrating the internal configuration of an ink supply valve according to an exemplary embodiment taken along the line IV-IV of FIG. 2A.
Figure 5:
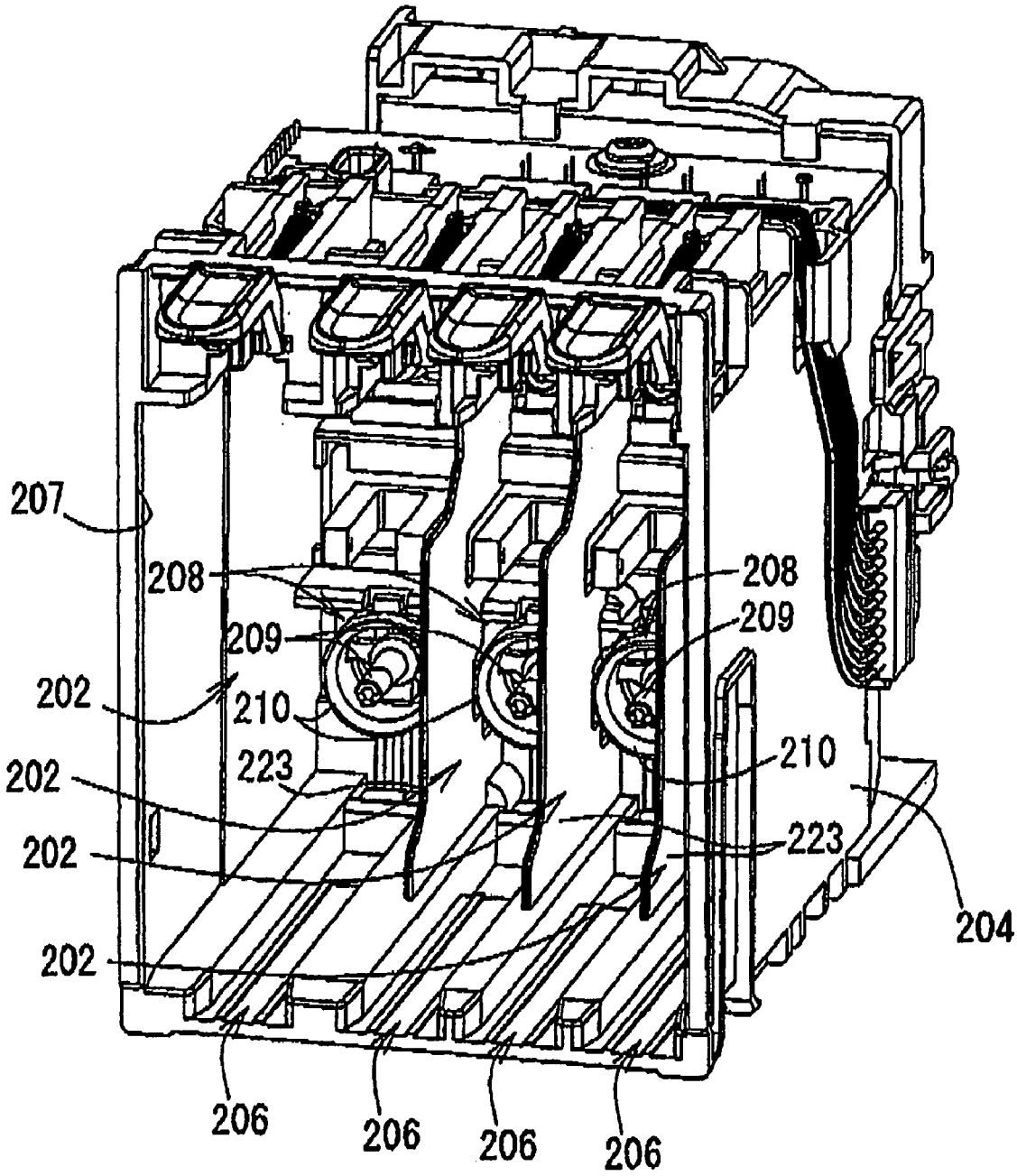
FIG. 5 is a perspective view illustrating the configuration of a cartridge mounting portion according to an exemplary embodiment.
Figure 6:
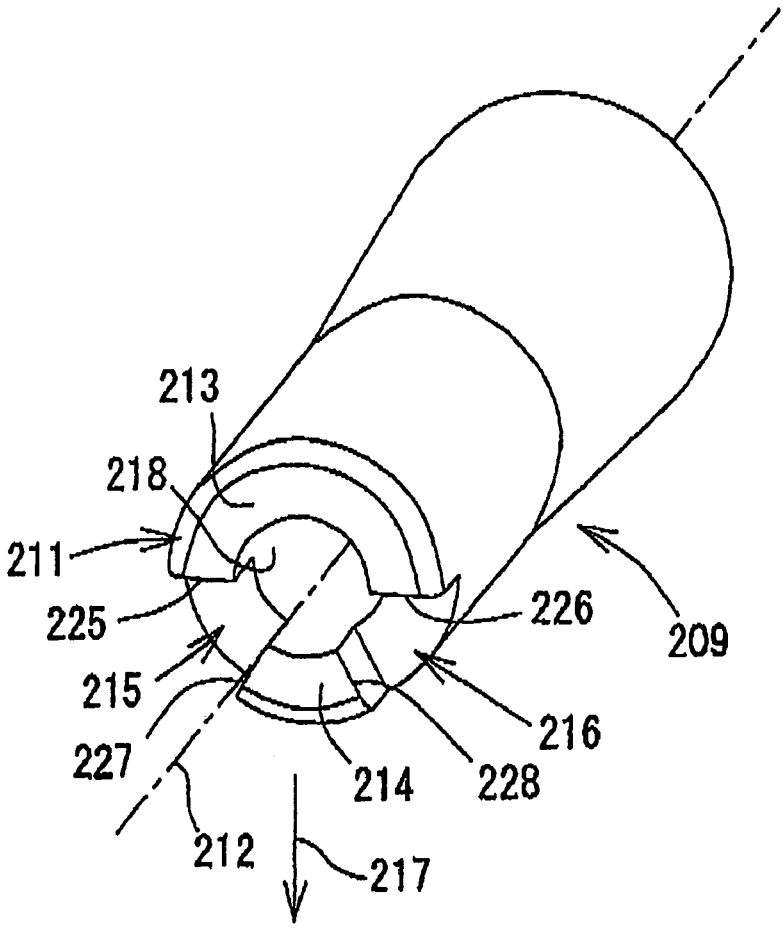
FIG. 6 is a perspective view illustrating the external configuration of an ink needle according to an exemplary embodiment.
Figure 7:
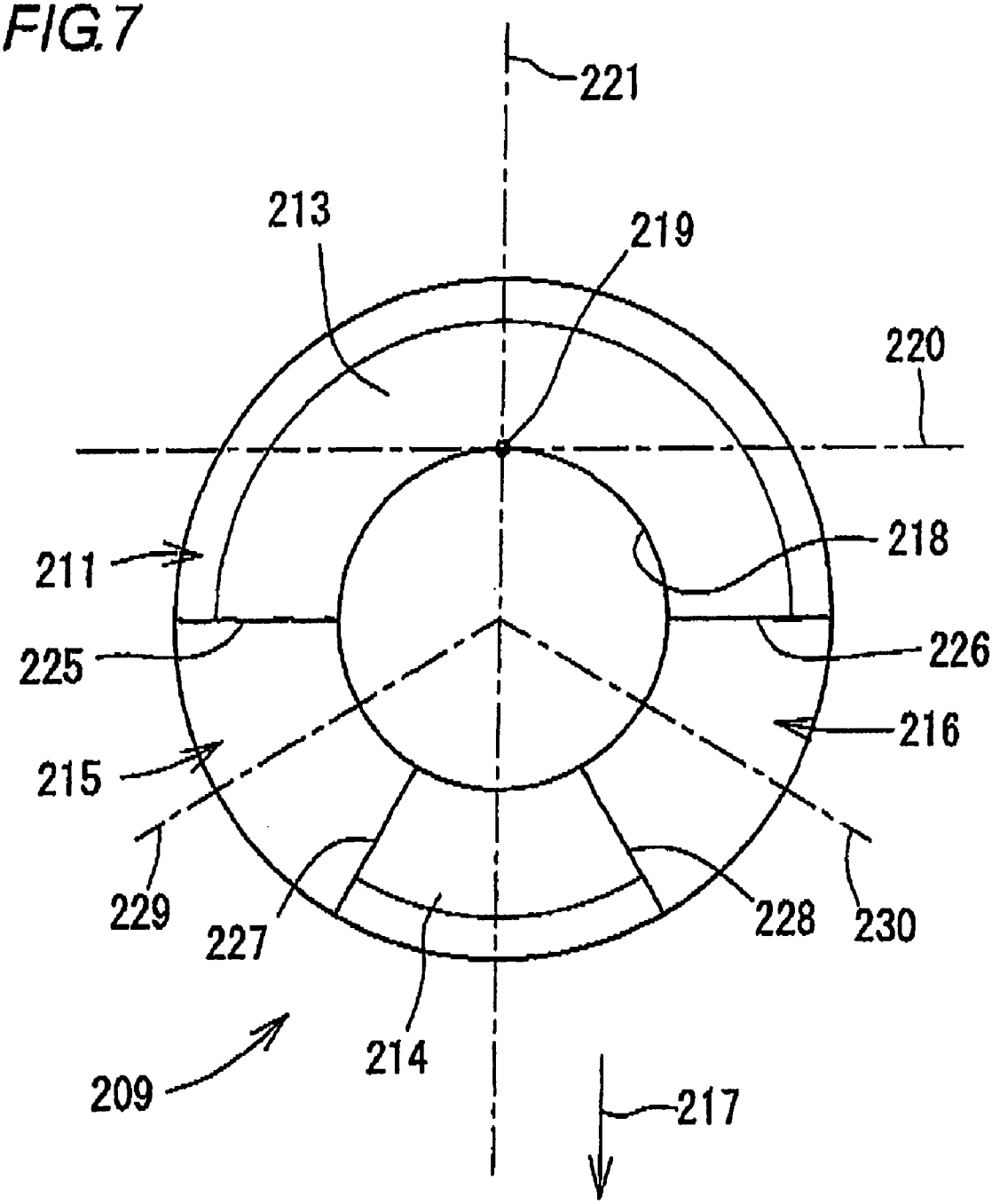
FIG. 7 is a front view illustrating a tip surface of the ink needle according to an exemplary embodiment, as viewed in the direction of an axis of the ink needle.
Figure 8:
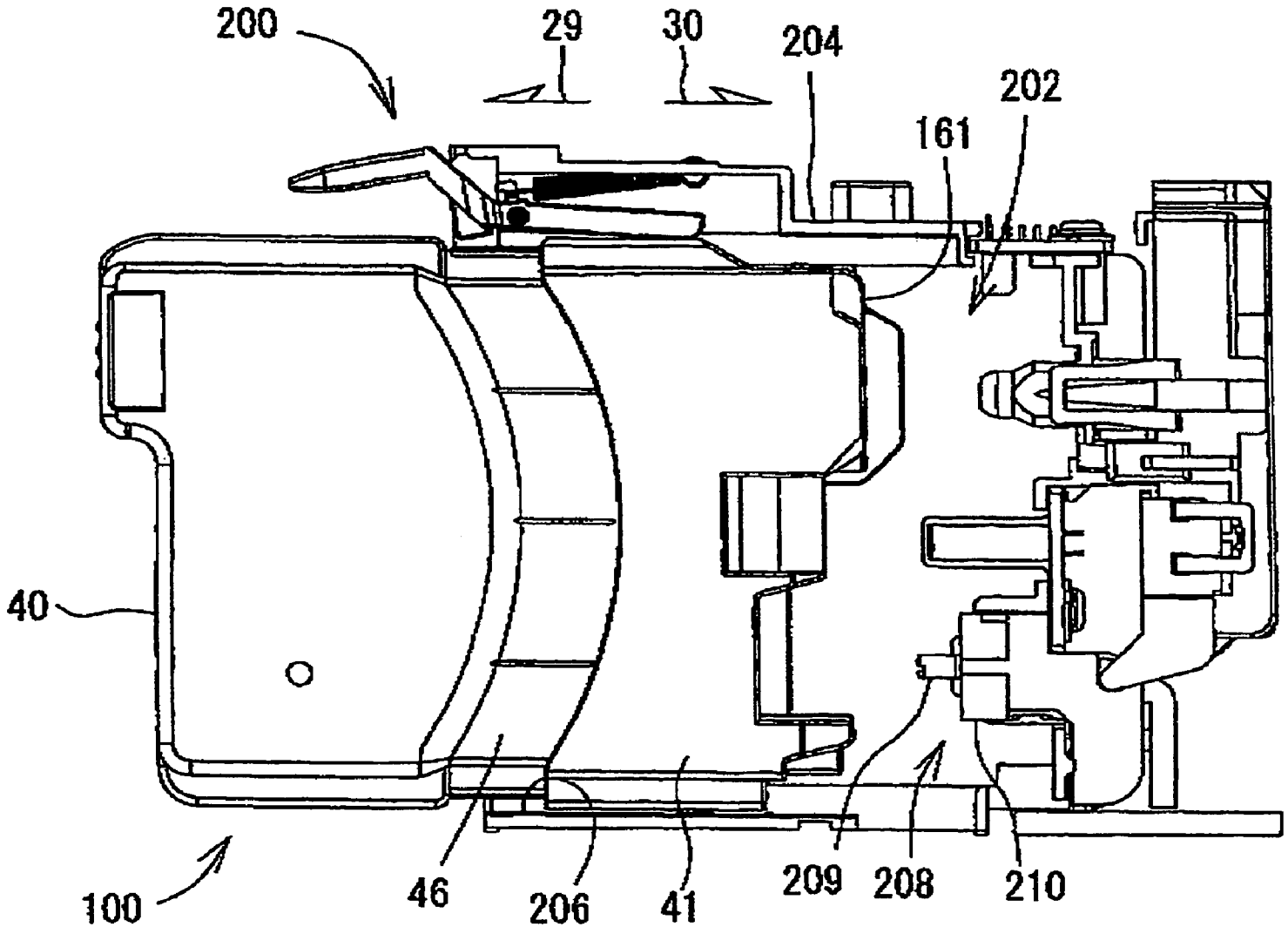
FIG. 8 is a diagram schematically illustrating the insertion of the ink cartridge into the cartridge mounting portion according to an exemplary embodiment.
Figure 9:
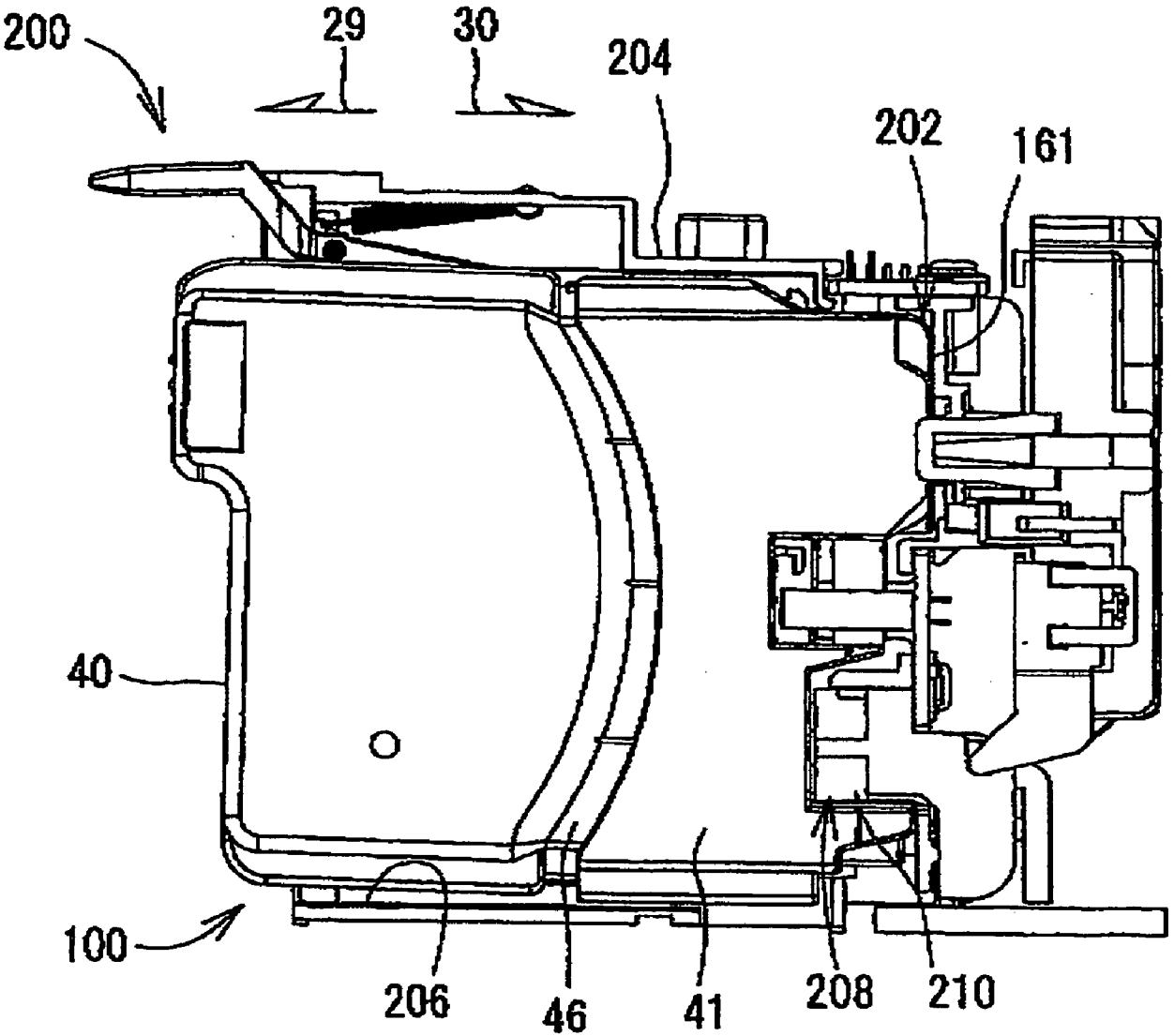
FIG. 9 is a diagram schematically illustrating the ink cartridge inserted into the cartridge mounting portion according to an exemplary embodiment.
Figure 10:
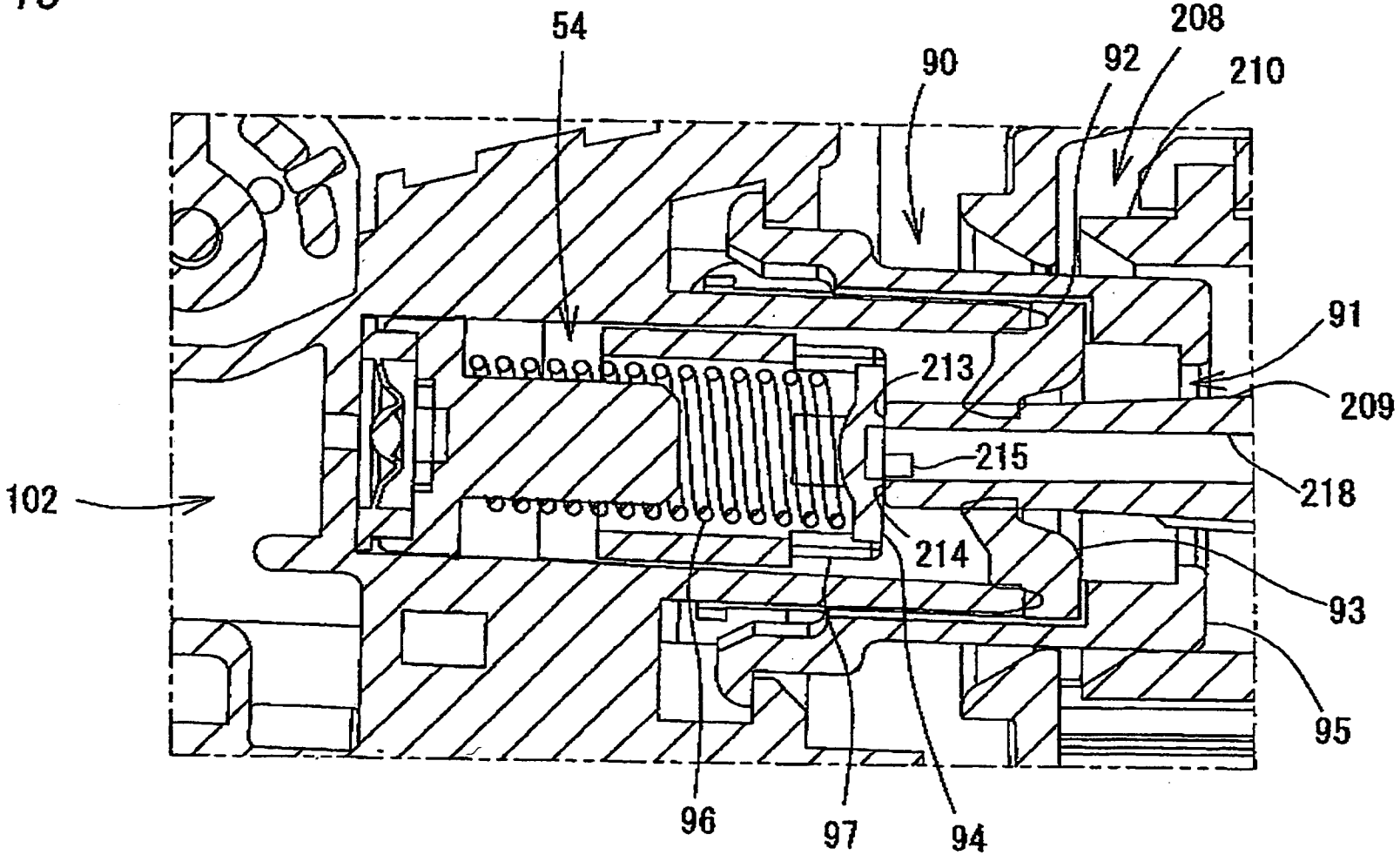
FIG. 10 is a cross-sectional view illustrating the opened state of the ink supply valve taken along the line IV-IV according to an exemplary embodiment.

FIG. 1 is a perspective view illustrating the external configuration of an ink supply device 200. FIG. 1 shows a state (inserted state) in which an ink cartridge 100 is inserted into the ink supply device 200. FIGS. 2A and 2B are perspective views illustrating the external configuration of the ink cartridge 100. Specifically, FIG. 2A is a perspective view illustrating a slider 41 disposed at an extension position, and FIG. 2B is a perspective view illustrating the slider 41 disposed at a contracted position. FIGS. 3A and 3B are side views illustrating the ink cartridge 100. Specifically, FIG. 3A is a side view illustrating the slider 41 disposed at the extension position, and FIG. 3B is a side view illustrating the slider 41 disposed at the contracted position. FIG. 4 is an enlarged cross-sectional view illustrating the internal configuration of an ink supply valve 90 taken along the line IV-IV of FIG. 2A. FIG. 5 is a perspective view illustrating the configuration of a cartridge mounting portion 202. FIG. 6 is a perspective view illustrating the external configuration of an ink needle 209. FIG. 7 is a front view illustrating a tip surface 211 of the ink needle 209, as viewed in the direction of an axis 212. FIGS. 8 and 9 are diagrams illustrating the insertion of the ink cartridge 100 into the cartridge mounting portion 202. FIG. 8 shows the ink cartridge 100 before insertion, and FIG. 9 shows the ink cartridge 100 after insertion. FIG. 10 is a cross-sectional view illustrating an ink supply valve 90 opened by the ink needle 209 taken along the line IV-IV.

[Schematic Configuration of Ink Supply Device 200]

Next, the schematic configuration of the ink supply device 200 will be described. The ink supply device 200 is applied to, for example, an apparatus which consumes ink (hereinafter, referred to as an 'ink consuming apparatus'), such as an ink-jet printer. The ink supply device 200 may be formed integrally with the ink consuming apparatus. For example, an opening which can be closed or opened by a cover is formed in a case of the ink consuming apparatus, and the ink supply device 200 is exposed to the outside through the opening.

The ink supply device 200 includes the ink cartridge 100 and the cartridge mounting portion 202. The ink cartridge 100 is a cartridge type, and is insertable to (mountable on) and removable from the cartridge mounting portion 202. The ink supply device 200 is configured such that four kinds of ink cartridges 100 can be inserted thereinto or removed therefrom. Each of the ink cartridges 100 stores any one of cyan, magenta, yellow, and black inks. In the ink supply device 200, color inks stored in the ink cartridges 100 inserted into the cartridge mounting portion 202 are supplied to a recording head of the ink-jet printer.

[Ink cartridge 100] Next, the detailed configuration of the ink cartridge 100 will be described. As shown in FIGS. 2A, 2B, 3A and 3B, the ink cartridge 100 has a substantially hexahedral shape. Specifically, the ink cartridge 100 has a substantially rectangular parallelepiped shape that has a small width (in the direction of an arrow 31) and a height (in the direction of an arrow 32) and a depth (in the direction of an arrow 33) that are larger than the width. The ink cartridge 100 is inserted into the cartridge mounting portion 202 in the direction of an arrow 30 (hereinafter, referred to as an 'insertion direction 30') in an erected state shown in FIGS. 2A, 2B, 3A and 3B, that is, with the bottom thereof facing downward and the top thereof facing upward in the drawings, and is removed in the direction of an arrow 29 (hereinafter, referred to as a 'removal direction 29'). In the specification, the lower surface and the upper surface of the ink cartridge 100 are defined in the erected state shown in FIGS. 2 and 3, if they are not particularly specified. The front side of the ink cartridge 100 in the insertion direction 30 is referred to as a rear surface, and the rear side of the ink cartridge 100 in the insertion direction 30 is referred to as a front surface. The definition of the upper, lower, front, and rear surfaces is similarly applied to a cartridge body 40 as well as the ink cartridge 100.

The ink cartridge 100 includes the cartridge body 40 having ink stored therein and the slider 41. The slider 41 covers a rear surface portion 46 of the cartridge body 40. The slider 41 can slide relative to the cartridge body 40 in the depth direction (in the direction of an arrow 33) between the extended position (see FIG. 2A) which is distant from the rear surface of the cartridge body 40 and the contracted position (see FIG. 2B) which is close to the rear surface of the cartridge body 40. When the slider 41 is disposed at the contracted position, an ink supply valve 90, which will be described below, protrudes from the slider 41 to the outside. When the slider 41 is disposed at the extended position, the ink supply valve 90 is inserted into the slider 41. The slider 41 is urged by a coil spring (not shown). When no external force is applied, the slider 41 is maintained at the extended position. The slider 41 may have any configuration.

The cartridge body 40 has a hollow box shape, and the internal space of the cartridge body serves as an ink chamber 102 (see FIG. 4) having ink injected thereinto. Predetermined ink is injected and stored in the ink chamber 102. The ink chamber 102 has a related-art configuration. Therefore, the ink chamber 102 may be provided with a float which detects the remaining amount of ink, a labyrinth mechanism or an air communicating valve which makes an air layer of the ink chamber 102 at the atmospheric pressure. Since these configurations are not related to the present invention, a detailed description thereof will be omitted in the specification.

The slider 41 has a shape of a container capable of containing the rear surface portion 46 of the cartridge body 40. An opening 178 is formed at a lower part of a wall 161 of the slider 41, the wall 161 being opposed to the rear surface of the cartridge body 40. The height of the opening 178 corresponds to the ink supply valve 90 with the slider 41 being incorporated into the cartridge body 40. The opening 178 has sufficient size and shape for the ink supply valve 90 to pass through. When the slider 41 is disposed at the contracted position, a cap 95 of the ink supply valve 90 is exposed through the opening 178.

As shown in FIGS. 2A to 4, the ink supply valve 90 is provided at a lower part of the rear surface of the cartridge body 40. The ink supply valve 90 is configured to close or open an ink passage extending from an opening 92 formed in the rear surface of the cartridge body 40 to the ink chamber 102. The ink supply valve 90 is provided in a valve accommodating chamber 54 which communicates with the ink chamber 102. The ink supply valve 90 includes a valve body 97, a coil spring 96, a seal member 93, and the cap 95.

The opening 92 is formed at the leading end of a cylindrical portion which protrudes from the rear surface of the cartridge body 40. The cap 95 is attached to the opening 92 with the seal member 93 interposed therebetween. The cap 95 makes the seal member 93 to liquid-tightly seal the opening 92. Through holes (not shown) are formed at the centers of the cap 95 and the seal member 93. The through holes are formed in a straight line to communicate with each other. An ink supply port 91 connecting the inside and the outside of the valve accommodating chamber 54 is formed by the through holes of the seal member 93 and the cap 95. When the ink cartridge 100 is inserted into the cartridge mounting portion 202, a tubular ink needle 209 (see FIG. 5) is inserted into the ink supply port 91.

The valve body 97 is guided by the inner wall of the valve accommodating chamber 54 and is movable between a first position which is separated from the seal member 93 and a second position which comes into close contact with the seal member 93. The valve accommodating chamber 54 is a portion of the ink chamber 102 and has a cylindrical shape. The size of the valve accommodating chamber 54 in the radial direction is slightly larger than that of the valve body 97, and the length thereof in the axial direction is sufficiently large to accommodate the slider of the valve body 97 or the coil spring 96. The valve body 97 has a cylindrical shape, and includes a contact wall 94 facing the seal member 93. When the contact wall 94 comes into close contact with the seal member 93, the ink supply port 91 is closed. A sufficiently large gap to allow ink to flow is formed between the circumferential surface of the valve body 97 and the inner wall of the valve accommodating chamber 54.

The coil spring 96 is accommodated in the valve accommodating chamber 54 and urges the valve body 97 in the direction in which the ink supply port 91 is closed. That is, the coil spring 96 urges the valve body 97 in the direction in which the valve body 97 approaches the seal member 93. Therefore, in the ink supply valve 90, when no external force is applied, the valve body 97 is disposed at the second position that comes into close contact with the seal member 93 to close the ink supply port 91. When the ink needle 209 is inserted into the ink supply port 91, the leading end of the ink needle 209 contacts the contact wall 94 of the valve body 97 to separate the valve body 97 from the seal member 93 against the urging force of the coil spring 96, thereby moving the valve body to the first position, and the ink supply port 91 is liquid-tightly sealed by the seal member 93 and an outer circumferential surface of the ink needle 209. Then, ink stored in the ink chamber 102 flows from the ink supply port 91 to the leading end of the ink needle 209 that is positioned closer to the inside than the seal member 93, and then supplied to a recording head of an ink consuming apparatus, such as an ink-jet printer, through the ink needle 209.

[Cartridge Mounting Portion 202]

Next, the detailed configuration of the cartridge mounting portion 202 will be described. As shown in FIG. 5, the cartridge mounting portion 202 includes a frame 204 having a rectangular parallelepiped shape having an opening 207 formed in the front surface thereof. The ink cartridges 100 are inserted through the opening 207, and the ink cartridges 100 are accommodated in the internal space of the frame 204 through the opening 207. In this exemplary embodiment, the cartridge mounting portion 202 has a space corresponding to each ink cartridge 100. That is, four cartridge mounting portions 202 are arranged in a line in the width direction (in the left-right direction of FIG. 5), and four ink cartridges 100 corresponding to cyan, magenta, yellow, and black can be inserted into the cartridge mounting portions 202. The width direction in which the cartridge mounting portions 202 are arranged in a line is the horizontal direction which is orthogonal to the insertion direction 30 of the ink cartridge 100.

As shown in FIG. 5, three plates 223 which partition the inner space into four longitudinal spaces are provided in the frame 204. The ink cartridges 100 are accommodated in four spaces (cartridge mounting portions 202) partitioned by the plates 223. The plates 223 are thin plates that protrude from the inner rear surface of the frame 204 to the front surface, and the front and rear surfaces of the plates 223 vertically extend in the inner space of the frame 204. The plates 223 are arranged in parallel to each other in the width direction (the left-right direction of FIG. 5) of the frame 204 at specific intervals. The gap between the inner surface of the frame 204 and the plate 223 or the gap between a pair of adjacent plates 223 corresponds to the width of the ink cartridge 100 to be inserted between the plates.

Four guide grooves 206 are formed in the bottom of the frame 204. Each of the guide grooves 206 is provided between the inner surface of the frame 204 and the plate 223 or between a pair of adjacent plates 223 so as to extend in a straight line from the opening 207 of the frame 204 to the inner rear surface of the frame. The ink cartridges 100 inserted into the cartridge mounting portions 202 of the frame 204 through the opening 207 are guided to the inner rear surface of the frame 204 by the guide grooves 206 in a predetermined insertion direction. The insertion direction is aligned with the insertion direction 30 of the ink cartridge 100.

Joints 208 are formed on the inner rear surface of the frame 204. The joints 208 are configured to be connected to the ink supply valves 90 of the ink cartridges 100 to drain ink from the ink chambers 102. Therefore, four joints 208 are provided to correspond to four ink cartridges 100 inserted into the cartridge mounting portions 202. Since four ink cartridges 100 are inserted into the frame 204 in the width direction thereof, the four joints 208 are also arranged in the width direction of the frame 204, and the height of each of the joints 208 corresponds to the height of the ink supply valve 90 of each of the ink cartridges 100 inserted into the cartridge mounting portions 202. In FIG. 5, the rightmost joint 208 is concealed by the frame 204.

Each of the joints 208 includes the ink needle 209 and a holding portion 210. The ink needle 209 is a cylindrical tube made of resin, and protrudes from the inner rear surface of the frame 204 to the front surface substantially in the horizontal direction which is orthogonal to the gravity direction. The leading end of the ink needle 209 is opened. The leading end is inserted into the ink supply valve 90 of the ink cartridge 100, and the ink supply valve 90 is opened. Although not shown in the drawings, the base of the ink needle 209 is connected to an ink tube on the rear surface of the frame 204, and the ink tube extends up to an ink consuming apparatus. The shape of the leading end of the ink needle 209 will be described below.

The holding portion 210 is a cylindrical member provided on the inner rear surface of the frame 204 so as to surround the base of the ink needle 209. When the ink cartridge 100 is inserted into the cartridge mounting portion 202, the cap 95 of the ink supply valve 90 is fitted into the holding portion 210, and the ink needle 209 is inserted into the ink supply port 91 of the ink supply valve 90.

The frame 204 may be provided with related-art configurations, such as an optical sensor which detects the insertion of the ink cartridge 100 or the remaining amount of ink and a lock mechanism which locks the ink cartridge 100 inserted into the cartridge mounting portion 202. Since these configurations are not related to the invention, a detailed description thereof will be omitted.

[Ink Needle 209]

As shown in FIGS. 5 and 6, the ink needle 209 has a substantially cylindrical shape, and ink passes through the inner space of the ink needle. The tip surface 211 of the ink needle 209 has a plane face which is orthogonal to the axis 212 of the ink needle 209, and has a substantially ring shape. The tip surface 211 includes first and second contact surfaces 213 and 214 which are configured to contact the contact wall 94 of the valve body 97 of the ink supply valve 90, and ink passages 215 and 216 through which ink flows from the ink chamber 102. The first contact surface 213 and the second contact surface 214 are portions of the tip surface 211. The ink passages 215 and 216 are concave portions which are formed in the tip surface 211 in the direction of the axis 212 and extend in the radial direction of the tip surface 211. The ink passages 215 and 216 formed in the tip surface 211 allow the inner space and the outer surface of the ink needle 209 to communicate with each other. The inner space of the ink needle 209 is surrounded by an inner surface 218.

As shown in FIGS. 6 and 7, the first contact surface 213 and the second contact surface 214 are vertically provided on the tip surface 211 in the gravity direction. The gravity direction is represented by an arrow 217 (hereinafter, referred to as a gravity direction 217). As show in FIG. 7, when the tip surface 211 of the ink needle 209 is viewed in the direction of the axis 212, a region of the tip surface 211, which is above a boundary line 220 extending in the horizontal direction on upper end 219 of the inner surface 208 of the ink needle 209 in the gravity direction 217, is referred to as a first region, and a region below the boundary line 220 is referred to as a second region. In addition, a line which extends in the gravity direction 217 through the center (the axis 212) of the tip surface 211 is referred to as a center line 221.

The first contact surface 213 includes the entire first region and a portion of the second region. The second contact surface 214 is a portion of the second region, and is arranged at the lowest part of the tip surface 211 in the gravity direction 217. Both the first contact surface 213 and the second contact surface 214 are arranged on the center line 221 and are symmetric with respect to the center line 221. That is, two edges 225 and 226 of the first contact surface 213 extending in the radial direction are symmetric with respect to the center line 221, and two edges 227 and 228 of the second contact surface 214 extending in the radial direction are symmetric with respect to the center line 221.

The ink passages 215 and 216 extend in the radial direction of the tip surface 211. The ink passage 215 is partitioned by a surface which extends from the edges 225 and 227 in the direction of the axis 212, and the ink passage 216 is partitioned by a surface that extends from the edges 226 and 228 in the direction of the axis 212. The ink passages 215 and 216 are provided in the second region so as to be symmetric with respect to the center line 221. In addition, the directions in which the ink passages 215 and 216 extend from the inner space of the ink needle 209 to the outside are represented by lines 229 and 230 in FIG. 7, and are inclined downward with respect to the horizontal direction.

[Connection Between Ink Supply Valve 90 and Ink Needle 209]

Next, an inserting operation of the ink cartridge 100 into the cartridge mounting portion 202 or removing operation of the ink cartridge 100 from the cartridge mounting portion 202 will be described. When the ink cartridge 100 is inserted, as shown in FIG. 8, the ink cartridge 100 is inserted into the cartridge mounting portion 202 through the opening 207 of the frame 204, with the rear surface thereof, that is, the slider 41 facing the cartridge mounting portion. The insertion direction 30 of the ink cartridge 100 is the horizontal direction. The bottom of the ink cartridge 100 is fitted into the guide groove 206 formed in the frame 204. When the ink cartridge 100 is pressed into the cartridge mounting portion 202, the ink cartridge 100 is guided in a straight line to the cartridge mounting portion 202 in the depth direction by the guide groove 206.

When the ink cartridge 100 is further pressed into the cartridge mounting portion 202, the rear wall 161 of the slider 41 contacts the inner rear surface of the cartridge mounting portion 202. When the ink cartridge 100 is further pressed into the cartridge mounting portion 202 after the slider 41 contacts the inner rear surface of the cartridge mounting portion 202, the cartridge body 40 is pressed into the cartridge mounting portion 202 while moving relative to the slider 41. As a result, the slider 41 is displaced from the extended position to the contracted position.

As shown in FIGS. 9 and 10, when the cartridge body 40 is moved, the cap 95 of the ink supply valve 90 is exposed through the opening 178 of the slider 41, and then fitted to the holding portion 210 of the joint 208. In addition, the ink needle 209 is inserted into the ink supply valve 90 against the urging force of the coil spring 96.

The outer circumferential surface of the ink needle 209 inserted into the ink supply port 91 of the ink supply valve 90 is liquid-tightly sealed by the seal member 93. The tip surface 211 of the ink needle 209 reaches the contact wall 94 of the valve body 97, and the first contact surface 213 and the second contact surface 214 contact the contact wall 94. In the valve body 97 disposed at the second position, the contact wall 94 is a substantially vertical surface that comes into close contact with the seal member 93, and the tip surface 211 is also a substantially vertical surface. The insertion direction 30 of the ink cartridge 100 is the horizontal direction. Therefore, the first contact surface 213 and the second contact surface 214 contact the contact wall 94 of the valve body 97 disposed at the second position substantially at the same time.

When the ink cartridge 100 is inserted, the first contact surface 213 and the second contact surface 214 move the valve body 97 from the second position to the first position against the urging force of the coil spring 96. The movement of the valve body 97 is guided by the inner wall of the valve accommodating chamber 54. However, since the first contact surface 213 and the second contact surface 214 are vertically provided in the gravity direction 217 and are symmetric with respect to the center line 221, the valve body 97 receiving the urging force of the coil spring 96 is stably supported by the first contact surface 213 and the second contact surface 214 during the movement. When the contact wall 94 of the valve body 97 is stably moved while being vertically arranged, the sliding resistance between the valve body 97 and the valve accommodating chamber 54 is reduced.

As shown in FIG. 10, when the valve body 97 is moved to the first position, the tip surface 211 of the ink needle 209 is completely inserted into the ink supply valve 90, and the ink supply valve 90 is opened. In the tip surface 211 inserted into the ink supply valve 90, the contact between the first and second contact surfaces 213 and 214 and the contact wall 94 is maintained by the urging force of the coil spring 96.

Since the ink passages 215 and 216 are formed in the tip surface 211, ink flowing from the ink chamber 102 to the valve accommodating chamber 54 flows to the inner space of the ink needle 209 through the ink passages 215 and 216, with the first and second contact surfaces 213 and 214 contacted with the contact wall 214, and is then supplied to an ink consuming apparatus through the ink tube.

The ink cartridge 100 inserted into the cartridge mounting portion 202 is kept in various postures before insertion or is treated in various posture during insertion, and the valve accommodating chamber 54 may be exposed to an air layer of the ink chamber 102. In this case, when the ink cartridge is inserted, air bubbles may remain in the valve accommodating chamber 54 even when the valve accommodating chamber 54 is filled with ink in the ink chamber 102. The air bubbles tend to remain, for example, in the vicinity of the upper surface of the valve accommodating chamber 54 or in the coil spring 96.

As described above, since the ink passages 215 and 216 are formed in the second region of the tip surface 211 and are provided at lower parts of the ink needle 209, the extension directions (lines 229 and 230) of the ink passages 215 and 216 are inclined downward with respect to the horizontal direction. Therefore, ink in the ink chamber 102 flows into the ink passages 215 and 216 from the lower side of the ink needle 209 in the ink supply valve 90, and no ink flows into the inner space from the upper side of the ink needle 209. In this case, the air bubbles remaining at the upper side of the ink supply valve 90 are difficult to descend to the lower side of the ink needle 209 and then flow to the inner space of the ink needle 209 together with ink because of buoyancy. As a result, it is possible to prevent the air bubbles from flowing to the inner space of the ink needle 209.

[Operations and Effects of the Exemplary Embodiment]

According to the ink supply device 200, in the tip surface 211 of the ink needle 209, the first contact surface 213 is provided in the entire first region, and the second contact surface 214 is provided in the second region. Therefore, the tip surface 211 contacts the contact wall 94 of the valve body 97 with a good balance. In this way, the valve body 97 can be reliably and stably moved by the ink needle 209. As a result, it is possible to prevent connection defects, such as the drain of ink from the ink chamber 102 and the damage of the ink needle 209, when the ink cartridge 100 is inserted into the cartridge mounting portion 202.

In the tip surface 211 of the ink needle 209, the ink passages 215 and 216 are provided in the second region, but the ink passages 215 and 216 are not provided in the first region. Therefore, it is possible to reduce or prevent air bubbles in the ink supply valve 90 from flowing into the ink needle 209 from the upper side thereof. In this way, it is possible to reduce or prevent the air bubbles remaining at the upper side of the ink needle 209 from flowing to the inner space of the ink needle 209 together with ink.

Further, the second contact surface 214 is arranged at the lowest part of the second region of the tip surface 211 in the gravity direction 217. Therefore, the first contact surface 213 and the second contact surface 214 contact the contact wall 94 of the valve body 97 in the gravity direction 217 with a good balance.

Furthermore, since a plurality of ink passages 215 and 216 are provided, it is possible to increase the amount of ink flowing to the inner space of the ink needle 209. In addition, it is possible to reduce the sizes of the ink passages 215 and 216, for example, the width of the ink passage partitioned by the edges 225 and 227 or the width of the ink passage partitioned by the edges 226 and 228, without reducing the flow rate of ink. Therefore, it is possible to prevent large air bubbles from flowing to the inner space of the ink needle 209. Furthermore, even when one of the ink passages 215 and 216 is clogged by, for example, air bubbles or sludge, the flowing of ink into the ink needle 209 is ensured by the other ink passage. In this exemplary embodiment, two ink passages 215 and 216 are provided, but the number of ink passages is not limited thereto.

The ink passages 215 and 216 are provided in the tip surface 211 of the ink needle 209 so as to be symmetric with respect to the center line 221. Therefore, a substantially same amount of ink flows from the ink chamber 102 to the ink needle 209 from the ink passages 215 and 216 with respect to the gravity direction 217, and ink stagnation does not occurs in the ink chamber 102. As a result, ink is smoothly drained.

In addition, since the ink passages 215 and 216 are provided so as to be symmetric with respect to the center line 221, the first contact surface 213 and the second contact surface 214 are also symmetric with respect to the center line 221. In this way, the first contact surface 213 and the second contact surface 214 contact the contact wall 94 of the valve body 97 in the horizontal direction with a good balance.

In this exemplary embodiment, the ink supply port 91 that allows the ink chamber 102 of the ink cartridge 100 to communicate with the outside is closed or opened by the ink supply valve 90. However, the cover that closes the hole of the ink cartridge according to the invention is not limited to a valve or a ball seal. For example, as the cover, a film may seal the hole to close the hole, and the tip surface of a cylinder may contact and penetrate the film to open the hole.

What is claimed is:

1. An ink supply device comprising:

a cartridge mounting portion for an ink cartridge, the ink cartridge including:

an ink chamber for storing ink, the ink chamber including a hole through which an inner space of the ink chamber is capable of communicating with an outside; and a cover which is configured to cover the hole;

wherein the cartridge mounting portion includes a cylinder extending in a direction intersecting with a gravity direction and is configured to removably mount thereon the ink cartridge while opening the cover by the cylinder;

wherein the cylinder comprises a tip surface including:

a first contact surface provided in at least an entire first region of the tip surface and configured to contact the cover, the first region being defined as a region above an upper end of an inner surface of the cylinder in the gravity direction;

a second contact surface provided in a second region other than the first region and configured to contact the cover; and a passage provided to extend in a radial direction of the cylinder to allow an inner space of the cylinder to communicate with an outside;

wherein any passage provided in the tip surface to extend in a radial direction of the cylinder to allow an inner space of the cylinder to communicate with an outside does not pass the first region; and wherein the second contact surface is provided at a lowest part in the second region in the gravity direction.

2. The ink supply device according to claim 1;

wherein the ink cartridge further includes a guide provided in a vicinity of the hole of the ink chamber, and an elastic member, wherein the cover is guided by the guide to be movable between a first position that opens the hole and a second position that closes the hole and is urged to the second position by the elastic member, and wherein the tip surface of the cylinder is configured to contact the cover and move the cover to the first position against the urging force of the elastic member.

3. The ink supply device according to claim 1;

wherein a plurality of passages are provided in the second region.

4. The ink supply device according to claim 3;

wherein the plurality of passages are provided in the second region of the tip surface symmetrically with respect to a center line which passes a center of the cylinder and in parallel with the gravity direction.

5. The supply device according to claim 1;

wherein the passage is defined between an edge of the first contact surface and an edge of the second contact surface.

6. The supply device according to claim 5;

wherein the edge of the first contact surface extends in a horizontal direction orthogonal to the gravity direction or in a direction inclined downward with respect to the horizontal direction.

7. An ink supply device comprising:

a cartridge mounting portion for an ink cartridge, the ink cartridge including:

an ink chamber for storing ink, the ink chamber including a hole through which an inner space of the ink chamber is capable of communicating with an outside; and a cover which is configured to cover the hole;

wherein the cartridge mounting portion includes a cylinder extending in a direction intersecting with a gravity direction and is configured to removably mount thereon the ink cartridge while opening the cover by the cylinder;

wherein the cylinder comprises a tip surface including:

a first contact surface provided in at least an entire first region of the tip surface and configured to contact the cover, the first region being located above an upper end of an inner surface of the cylinder in the gravity direction;

second contact surface provided in a second region of the tip surface other than the first region and configured to contact the cover; and a passage provided in the second region of the tip surface to extend in a radial direction of the cylinder to allow an inner space of the cylinder to communicate with an outside; and wherein the second contact surface is provided at a lowest part in the second region of the tip surface in the gravity direction.

8. The ink supply device according to claim 7;

wherein the ink cartridge further includes a guide provided in a vicinity of the hole of the ink chamber, and an elastic member, wherein the cover is guided by the guide to be movable between a first position that opens the hole and a second position that closes the hole and is urged to the second position by the elastic member, and wherein the tip surface of the cylinder is configured to contact the cover and move the cover to the first position against the urging force of the elastic member.

9. The ink supply device according to claim 7;

wherein a plurality of passages are provided in the second region of the tip surface.

10. The ink supply device according to claim 9;

wherein the plurality of passages are provided in the second region of the tip surface symmetrically with respect to a center line which passes a center of the cylinder and in parallel with the gravity direction.

11. The supply device according to claim 7;

wherein the passage is defined between an edge of the first contact surface and an edge of the second contact surface.

12. The supply device according to claim 11;

wherein the edge of the first contact surface extends in a horizontal direction orthogonal to the gravity direction or in a direction inclined downward with respect to the horizontal direction.

* * * * *